US005755627A

United States Patent [19]

Yamazaki et al.

[11] Patent Number: 5,755,627

[45] Date of Patent: May 26, 1998

[54] METAL HOLLOW GOLF CLUB HEAD WITH INTEGRALLY FORMED NECK

[75] Inventors: Satoshi Yamazaki; Shigeki Ohno; Yasuo Dotani, all of Okegawa, Japan

[73] Assignee: Mitsubishi Materials Corporation, Tokyo, Japan

[21] Appl. No.: 767,836

[22] Filed: Dec. 17, 1996

[30] Foreign Application Priority Data

Feb. 8, 1996 [JP] Japan ..... 8-022892

[51] Int. Cl.[6] ..... A63B 53/04

[52] U.S. Cl. ..... 473/345; 473/346; 473/305

[58] Field of Search ..... 473/324, 345, 473/346, 305, 311

[56] References Cited

U.S. PATENT DOCUMENTS

| | | | |
|---|---|---|---|
| 4,214,754 | 7/1980 | Zebelean | 473/346 |
| 4,432,549 | 2/1984 | Zebelean | 473/346 |
| 5,028,049 | 7/1991 | McKeighen | 473/345 |
| 5,056,705 | 10/1991 | Wakita et al. | 473/346 X |
| 5,346,217 | 9/1994 | Tsuchiya et al. | 473/345 |
| 5,429,365 | 7/1995 | McKeighen | 473/346 |
| 5,460,371 | 10/1995 | Takeda | 473/345 |
| 5,464,211 | 11/1995 | Atkins, Sr. | 473/346 X |
| 5,533,729 | 7/1996 | Leu | 473/346 |
| 5,538,246 | 7/1996 | Dekura | 473/346 X |
| 5,547,427 | 8/1996 | Rigal et al. | 473/346 X |
| 5,624,331 | 4/1997 | Lo et al. | 473/346 X |

*Primary Examiner*—Raleigh W. Chiu

*Attorney, Agent, or Firm*—Armstrong, Westerman, Hattori, McLeland, & Naughton

[57] ABSTRACT

A metallic golf club head that has an end portion, on which a neck part is integrally formed, and a hollow portion therein. The golf club head further has a face member, which is formed integrally with the neck part by forging, and a hollow member that is welded to a peripheral edge portion of the face member and, with the face position, composes the hollow portion. The face member is provided with a face portion, whose front surface is a face surface and whose rear surface is formed flat, and a raised portion formed like a ring in such a way as to project from a peripheral edge part of the face portion in a direction opposite to a direction to which the face surface is faced. A rear-end peripheral edge part of the raised portion is butt-welded to a front-end peripheral edge part of the hollow member.

17 Claims, 7 Drawing Sheets

FIG. 1
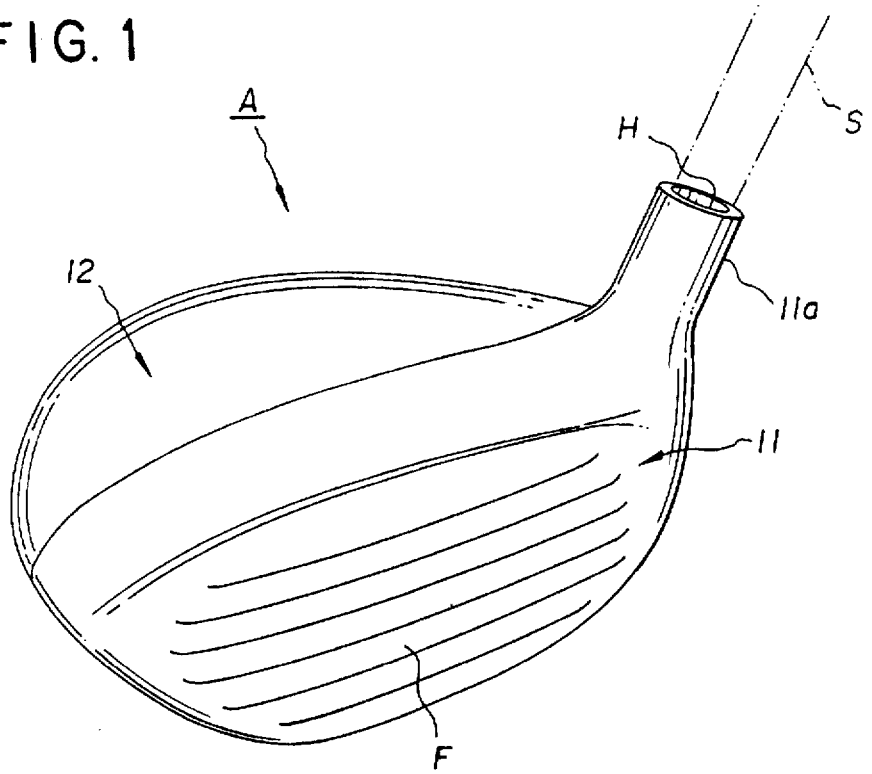
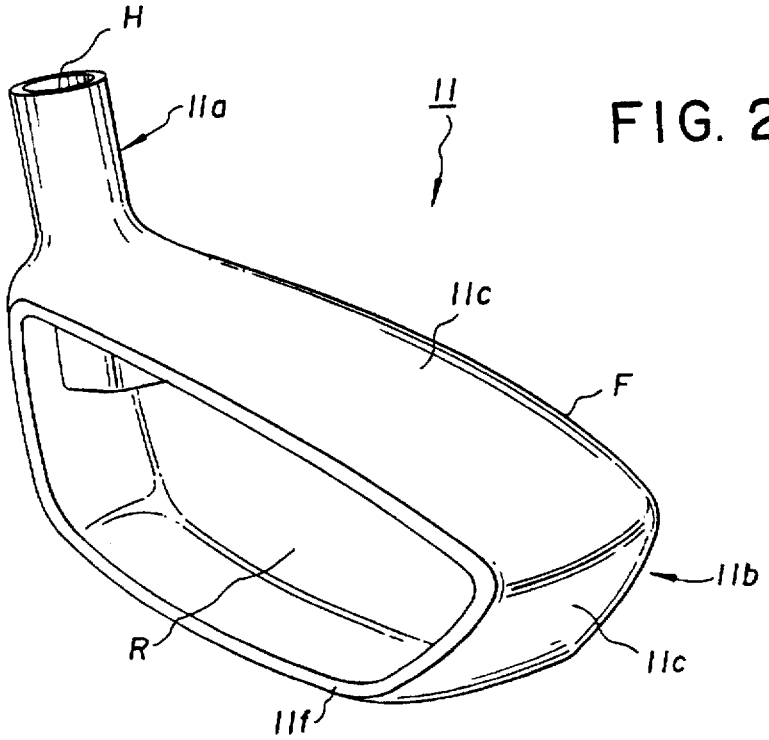
FIG. 2

FIG. 6
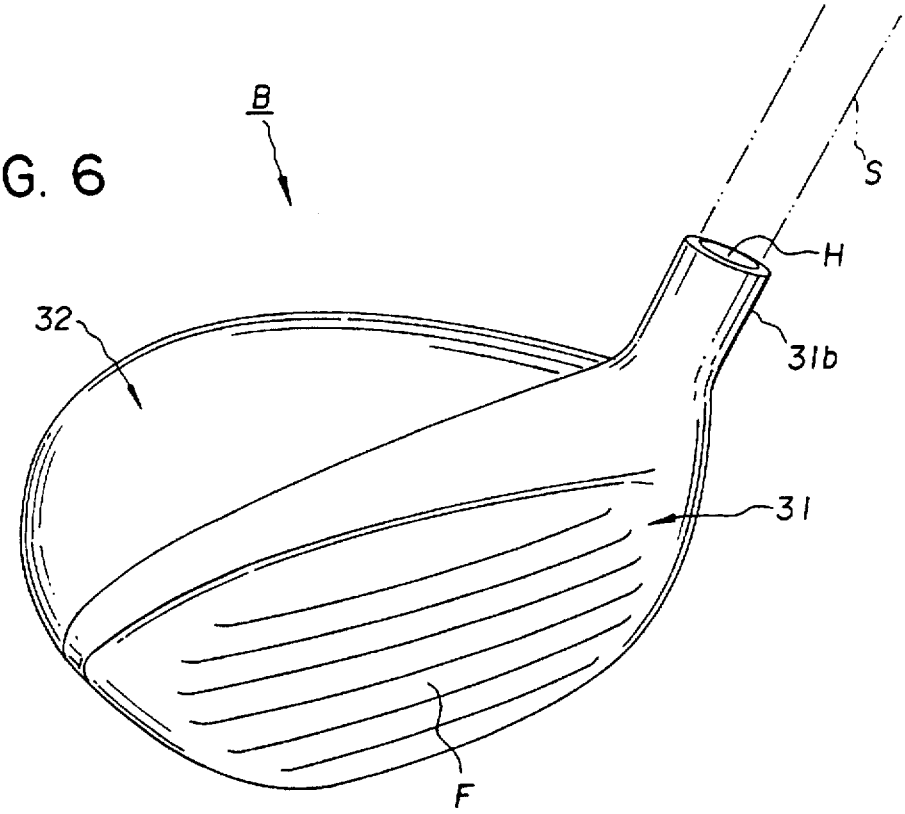
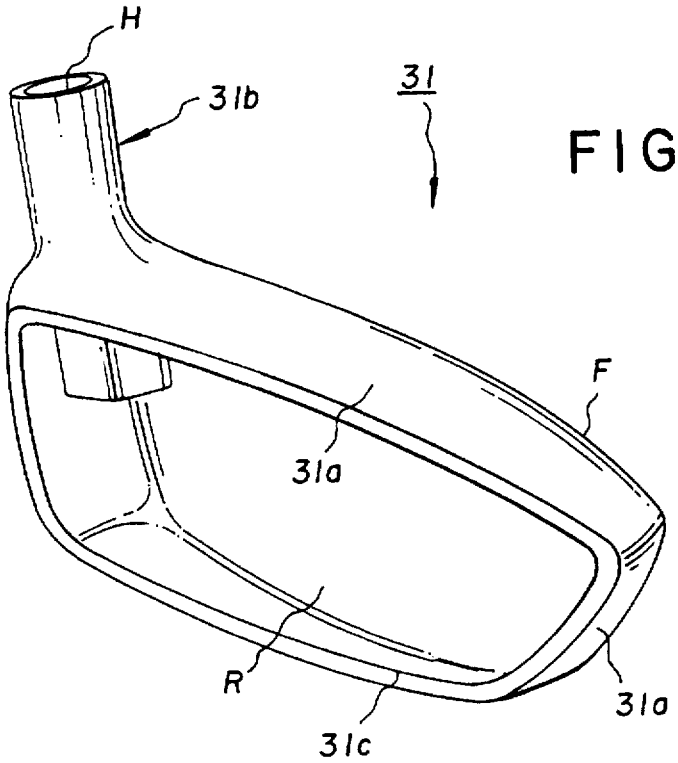
FIG. 7

METAL HOLLOW GOLF CLUB HEAD WITH INTEGRALLY FORMED NECK

BACKGROUND OF THE INVENTION

1. Field of the Invention

The present invention relates to a metallic golf club head having an end-portion, with a neck part formed integrally therein, and a hollow portion in the club head.

2. Description of the Related Art

In recent years, there have appeared club heads for golf clubs called "metal woods", such as drivers or the like, which have club heads made of a metal or an alloy (hereunder, such a golf club will be sometimes referred to as a "metal wood"). The characteristic aspects of this "metal wood" reside in that the distance a hit ball flies is increased and that a golf ball can be-easily hit with high directional accuracy thereof (namely, with high accuracy of a direction in which the hit ball flies). Thus, the "metal wood" has come into widespread use.

Recently, there has been proposed a "metal wood" having a club head made of titanium, or a titanium alloy, which is superior in repulsion force and corrosion resistance to other metals and alloys and is lightweight. FIG. 13, hereof, is a diagram illustrating an example of a "metal wood" of such a type (as provided by the Japanese Unexamined Patent Publication No. 62-154186).

This titanium, or titanium-alloy, head is made as follows. First, the titanium, or the titanium alloy is pressed into a face shell (or crust) piece 1, an upper-face shell piece 2 and a sole-face shell piece 3. Subsequently, a balance weight 4 is attached to an inner surface of the sole-face shell piece 3. Thereafter, the plurality of pieces 1, 2 and 3 are integrated with one another by welding.

In the case of the aforementioned conventional golf club head, there are still the following problems to be solved.

A face edge portion 1*a* of the face shell piece 1 and an upper-face edge portion 2*a* of the upper-face shell piece 2 and a sole-face edge portion 3*a* of the sole-face shell piece 3*a*, which are welded to the face edge portion 1*a*, are welded together into a corner joint and are jointed in such a way that a welding portion (namely, a weld) A is in a bending state, as shown in FIG. 14. Thus, the conventional golf club head has an inconvenience in that the club head cannot obtain high stiffness (or rigidness) against a load imposed on the welding portion at the time of impact. Strong bending stress is exerted on the welding portion owing to the deflection of the face shell piece 1, which occurs upon impact, and as a result, the welding portion becomes deformed. To eliminate this inconvenience, a rib portion, having increased thickness, or the like, has been employed in the back surface part of the face shell piece 1 to thereby increase the stiffness of the club head. In this case, owing to the presence of the rib portion, or the like, the face shell piece 1 becomes hard to deflect, and the deflection of the face shell piece 1 becomes nonuniform. Consequently, the directional accuracy of a hit ball, namely, the accuracy of a direction in which a hit ball flies, is deteriorated.

Further, a neck part 5, FIG. 13, into which a shaft is inserted and fit, is formed by joining half tubular fitting parts 2*b* and 3*b* of the upper-face shell piece 2 and the sole-face shell piece 3 together. Thus, the conventional club head has presented problems in that it takes time and effort to weld and assemble parts of the club head and in that the stiffness thereof is low because of the fact that welded parts form a large proportion of the club head. Moreover, the conventional club head has presented problems in that it is difficult to obtain high accuracy in fitting the shaft thereto and that, among such club heads, there is a large variation in loft angle of the club.

Furthermore, in the conventional club head, a balance weight 4 should be provided at a suitable position on an inner surface of the sole-face shell piece 3 as a separate member, in order to perform the fine adjustment of the position of the center of gravity thereof. Thus, the conventional club head has encountered the problem in that the provision of such a balance weight results in an increased number of components and an increased number of steps in the fabrication process.

SUMMARY OF THE INVENTION

It is, therefore, an object of the present invention to provide a golf club head that has high-stiffness face, neck and welding portions and is superior in the directional property (or accuracy) of a hit ball, namely, the accuracy of a direction in which a hit ball flies, and is fit with a shaft with high precision.

To achieve the foregoing object, in accordance with the present invention, there is provided a metallic golf club head having an end portion, on which a neck part is formed, and a hollow portion in the head. Such a golf club head comprises: a face member molded integrally with the neck part; and a hollow member welded to a peripheral edge (or rim) portion of the face member and composes the hollow portion. The face member has a face portion, whose front surface is a face surface of the club, and a raised portion (or wall portion) formed like a ring extending around the face portion in such a way as to project from a peripheral edge part of the face portion in a direction opposite to a direction in which the face surface is directed. A rear-end peripheral edge part of the raised portion is welded to the front-end peripheral edge part of the hollow member by butting the rear-end peripheral edge part of the raised portion and the front-end peripheral edge part of the hollow member.

In the case of this golf club head, a load imposed on the face portion at the moment of impact is transferred from the rear-end peripheral edge part of the raised portion to the front peripheral edge part of the hollow member by butt-welding the rear-end peripheral edge part of the raised portion to the front peripheral edge part of the hollow member. Thus, the load is caught by both of the face member and the hollow member, so that no stress concentration occurs in a welding portion.

Moreover, the stiffness of the face portion is increased. Thus, the thickness and weight of the club head can be reduced and a golf club head of large capacity can be obtained.

Furthermore, as a result of the molding of the face member integrally with the neck part, the stiffness of the neck part becomes higher than that thereof in the case that the neck part is formed by welding. Thus, the variation in loft angle among produced golf club heads can be reduced.

In one embodiment, the golf club head of the present invention is provided with a protruding portion which extends in a direction of the prolonged line of the neck part and protrudes inwardly from the face portion. The stiffness of the neck part and vicinity is increased. Further, the neck part is securely integrated with the shaft. A load imposed on the face portion at the time of impact is securely transferred to the shaft. Consequently, the pleasant feeling afforded by hitting a ball is improved.

If the bottom position of the protruding portion is set in such a way as to be lower than the center of figure of the face surface, the stiffness of the face member is further increased. Moreover, the center of gravity of the entire golf club head is lowered. Consequently, the pleasant feeling afforded by hitting a ball is further enhanced.

In a further embodiment, the face member is formed by forging and the hollow member is formed in one piece by precision-casting. The stiffness thereof is high and the thickness and weight thereof can be reduced.

The hollow member is formed by the precision casting. Thus, the degree of freedom of choice of a shape thereof when produced is high. Furthermore, the thickness of each part thereof is freely set.

In another embodiment of the golf club head of the present invention, the face member and/or the hollow member are molded of a titanium alloy. Where the face member is molded of titanium alloy, which has a fine structure, high stiffness is obtained. Furthermore, the strength thereof can be increased by a thermo-mechanical treatment. Thereby, the thickness of the face portion, crown part, side part and sole part can be reduced.

In a further embodiment of golf club head of the present invention, at least the face portion is molded of a β titanium alloy or a near-β titanium alloy. When at least the face portion is molded of a β titanium alloy or a near-β titanium alloy, high strength thereof can be obtained because of the fine structure of the alloy. Moreover, because the alloy can be forged at a relatively low temperature (750° C.), the cost of manufacturing is low.

In a still further embodiment of the present invention, the hollow member consists of: a crown part which is an upper division thereof; a side part which is a side division thereof; and a sole part is a bottom division thereof. Further, the thickness t1 of the crown part, the thickness t2 of the side part and the thickness t3 of the sole part meet the following relations: $t1 \leqq t2 \leqq t3$; and $t1 < t3$. In this embodiment of the present invention, the thickness of the hollow member becomes gradually larger toward the sole part. This results in the low center of gravity of the golf club head. Moreover, the sole part, which frequently comes into contact with the ground, has the highest stiffness and is thus hard to deform.

In a further embodiment, the thickness of the hollow member is set at a value which is within a range of (⅓) of the thickness of the face portion to (½) thereof. As a result of setting the thickness of the hollow member at a value which is within a range of (⅓) of the thickness of the face portion to (½) thereof, a golf club head of large capacity can be obtained without deteriorating the stiffness of the entire golf club head and causing an increase in weight of the golf club head.

BRIEF DESCRIPTION OF THE DRAWINGS

The preferred embodiment of the present invention will be described in detail by referring to appended drawings; in which:

FIG. 1 is a perspective view showing a golf club head embodying the present invention in a first embodiment of the present invention;

FIG. 2 is a further perspective view of the embodiment of FIG. 1, showing a face member of the golf club head;

FIG. 6 is a perspective view showing another embodiment of a golf club head embodying the present invention;

FIG. 7 is a perspective view showing a face member of the golf club head of the embodiment of FIG. 6;

DETAILED DESCRIPTION OF THE PREFERRED EMBODIMENTS

Referring to FIG. 1, there is shown a club head A (namely, what is called a "metal head"), to which the present invention is applied. The club head A consists of a face member 11 and a hollow member 12.

The face member 11 is formed from a B titanium alloy by hot die forging and is molded integrally with a neck part 11*a* to which a shaft S is attached. As shown in FIG. 2, the face member 11 is composed of a face portion 11*b*, whose front face is a face surface F, and a raised portion 11*c* which is formed like a ring and is raised in such a manner as to project from the peripheral edge part of the face portion 11*b* in a direction opposite to a direction to which the face surface F faces.

Further, the raised portion 11*c* is formed in such a way as to have a nearly constant width that is larger than the diameter of the neck part 11*a*. The face portion 11*b* has a rear face R which is formed flat.

The neck part 11*a* is formed in such a way that an upper division thereof has a circular section and a lower division thereof has a rectangular section. The neck part 11*a* is provided in such a manner that the lower division thereof is placed at an end part of the face portion 11*b*. Further, a shaft insertion hole H is bored in the neck part 11*a* by machining. The shaft insertion hole H penetrates the neck part 11*a* from the upper end to the bottom end of the lower division thereof. The shaft S is inserted by an appropriate means thereinto and is fixed thereto.

Figure 3:
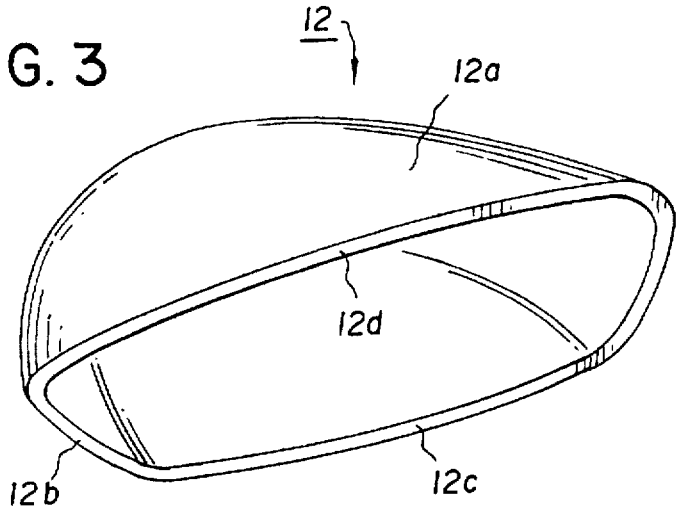
FIG. 3 is another perspective view of the embodiment of FIG. 1, showing a hollow member of the golf club head.
Figure 4:
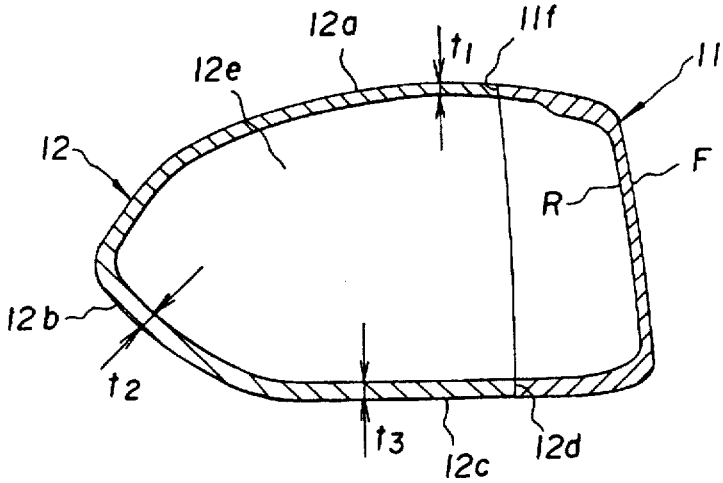
FIG. 4 is a longitudinal sectional view of the golf club head of FIG. 1.

The hollow member 12 is made of, for example, a 6A1-4v titanium alloy and is formed by precision casting process, namely, a lost-wax process. As illustrated in FIGS. 3 and 4, a crown part 12*a* constitutes an upper division of the hollow member 12, a side part 12*b* constitutes a side division thereof, and a sole part 12*c* constitutes a bottom division thereof. The crown part 12*a*, the side part 12*b*, and the sole parte 12*c* are formed in a single piece.

Further, a hollow portion 12*e* is formed by butt-welding the rear-end peripheral edge part 11*f* of the raised portion 11*c* to the front-end peripheral edge part 12*d* of the hollow member 12.

Here, t1, t2 and t3 denote the thickness of the crown part, the thickness of the side part and the thickness of the sole part, respectively. These thicknesses are set in such a manner as to meet the following relations:

$t1 \leqq t2 \leqq t3$; and $t1 < t3$.

Furthermore, the thickness of the front-end peripheral edge part 12*d* of the hollow member 12 is set in such a way as to be equal to that of the raised portion 11*c*.

In this embodiment, the thickness of the face portion 11*b*, FIG. 2, is set at a value in the range of 1.6 to 2.8 mm. Further, the thicknesses t1, t2 and t3 of the aforementioned parts of the hollow member 12 are set in such a manner as to meet the aforesaid conditions and to be in the range of 0.4 to 8.0 mm. Moreover, let W designate the weight of the face member 11. Furthermore, the weight of the hollow member 12 is set in the range of 1.6×W to 3.0×W.

The face member 11 is molded by performing the following production process.

Figure 5:
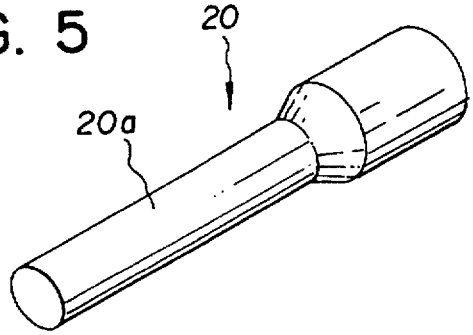
FIG. 5 is a perspective diagram showing a stepped round bar of a material of the face member of the golf club head of FIG. 1.

As illustrated in FIG. 5, a cylindrical stepped round bar 20, which is made of a β Ti alloy and has a small diameter portion 20*a* at one end thereof, is used as the material of the face member 11.

First, the stepped round bar 20 is heated to a temperature in a hot working temperature range. Moreover, a die forging process is performed on the heated bar 20 and the round bar 20 is shaped into the form of the face member 11.

Therefore, an aging treatment is performed directly on the face member 11 without performing a solution (heat) treatment process.

In the aforementioned production process, a solution (heat) treatment process is omitted after the hot die forging. Thus, the production process is simplified. Moreover, the strength of the member is increased owing to the mutually potentiating effects of a work (or strain) hardening and an age-hardening. As a result of this process, the strength of the member is increased by 10 to 15% in comparison with a conventional case of employing a solution (heat) treatment process.

Furthermore, this member is formed by forging. Thus, even after the forging, metallic fibers contained therein are in a continuous state. Consequently, as compared with a case of employing a sheet metal working or the like, the strength of the member can be maintained at a high level.

In the case of the golf club head A having the aforementioned configuration, a load imposed on the face portion 11*b* at the moment of impact is transferred from the rear-end peripheral edge part 11*f* of the raised portion 11*c* to the front-end peripheral edge part 12*d* of the hollow member 12 by butt-welding the rear-end peripheral edge part 11*f* of the raised portion 11*c* to the front-end peripheral edge part 12*d* of the hollow member 12. Thus, the load is caught by both of the face member 11 and the hollow member 12, so that no stress concentration occurs in the welding portion. Moreover, the face member 11 is formed by forging, so that a high stiffness is obtained in the welding portion and a bending stress imposed on the welding portion is suppressed.

The raised portion 11*c* is linearly formed in such a way as to have a nearly constant width. Thus, there are no projections and depressions on the surfaces of the rear-end peripheral edge part 11*f* and the front-end peripheral edge part 12*d*, which face to each other. Consequently, the welding is facilitated and a die for molding can be easily made.

Besides, a part, which is placed in the vicinity of the neck part 11*a*, of the raised portion 11*c* has a width which is larger than the diameter of the neck part 11*a*. The raised portion 11*c*, thus, has strong stiffness against a twist which is caused around the neck part 11*a* at the time of impact with a golf ball.

The face portion 11*b* is also formed by forging, and thus has high stiffness. Consequently, the thickness and weight of the club head can be reduced.

The face portion 11 is molded integrally with the neck part 11*a*, so that the stiffness of the neck part 11*a* is increased in comparison with the case of forming thereof by welding. The variation in loft angle among produced golf club heads is reduced.

The hollow member 12 is formed by the precision casting. Thus, the degree of freedom of choice of a shape thereof, when produced, is high. Furthermore, the thickness of each part thereof is freely set. Hence, even if a balance weight is not provided in the club head separately from the hollow member 12, the weight balance of the hollow member 12 and the golf club head can be regulated by setting the thickness of each component of the golf club head correspondingly to each kind (or model) of the golf club head.

Moreover, the face member 11 is molded of a titanium alloy, so that high stiffness thereof is obtained. Furthermore, the strength thereof can be increased to a high level by a thermo-mechanical treatment. Consequently, the final thickness of the face portion 11*b* can be reduced to a small value.

Besides, the thickness of the raised portion 11*c* is larger than that of the face portion 11*b*. Thus, the raised portion 11*c* has high stiffness. Further, a deflection of the face portion 11*b* upon impact is abated by the raised portion 11*c*. Moreover, the bending stress imposed on the welding portion is further reduced.

Additionally, the hollow member 12 is formed so that the thickness thereof becomes gradually larger toward the sole part. Thus, the center of gravity of the golf club head is lowered. Further, the golf club head is adapted so that the sole part, which frequently comes into contact with the ground, has the highest stiffness and is hard to deform.

Figure 8:
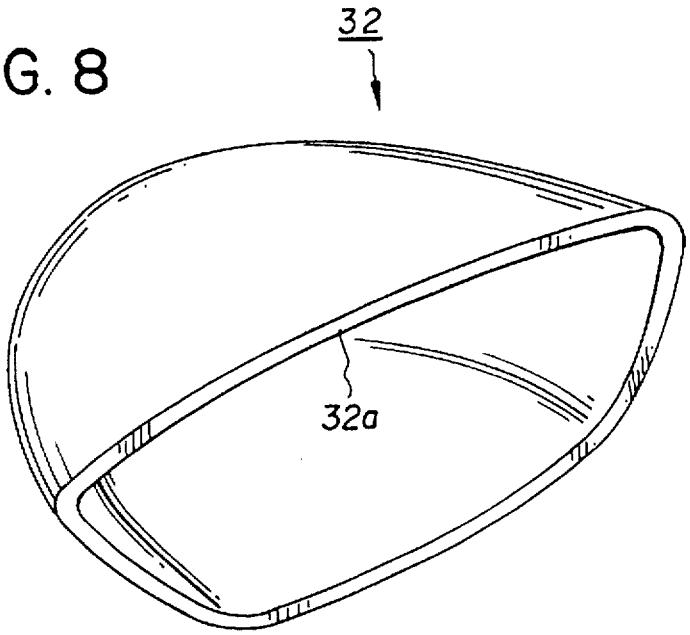
FIG. 8 is a perspective view showing a hollow member of the golf club head, in a second embodiment of the present invention.

Next, the second embodiment of the present invention will be described hereinbelow by referring to FIGS. 6 to 8.

Referring to FIG. 6, there is shown a club head B (namely, what is called a "metal head"), to which the present invention is applied. The club head B consists of a face member 31 and a hollow member 32.

The differences between the first embodiment and the second embodiment of the present invention reside in that the raised portion 11*c* of the first embodiment (namely, the club head A) is formed in such a way as to have a width which is nearly equal around the peripheral edge part of the face portion 11*b*, whereas the raised portion 31*a* of the second embodiment (namely, the club head B) is formed in such a manner as to have a width which gradually decreases in a direction from the neck part 31*b* to a toe, and in that a front-end peripheral edge part 32*a* of the hollow member 32 is formed correspondingly to a rear-end peripheral edge part 31*c* of this raised portion 31*a*.

Namely, when making the face member 31, a toe-side portion thereof is formed by causing the plastic deformation of a small-diameter portion 20*a* of the round bar material 20. At the toe-side thereof, the raised portion 31*a* has a narrow width. The second embodiment, thus, has an advantage in that the required quantity of the deformation can be small and that even in the small-diameter portion 20*a*, whose material quantity is small, the forging can be easily performed.

Next, the third embodiment of the present invention will be described hereinbelow by referring to FIG. 9.

Figure 9:
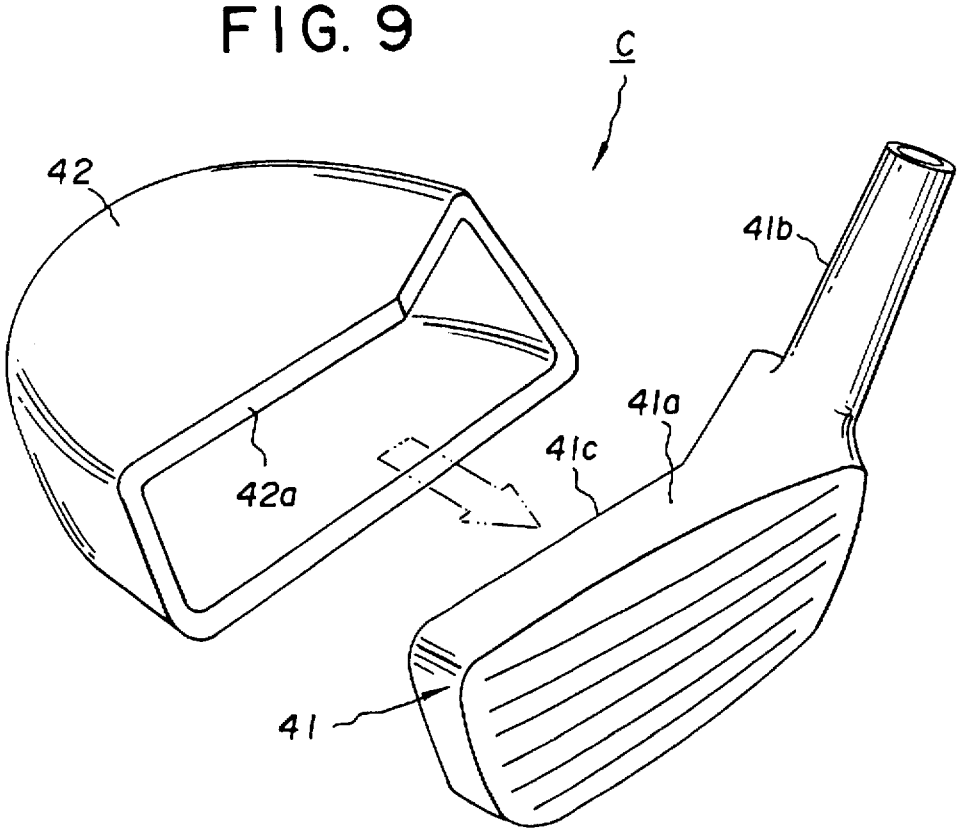
FIG. 9 is an exploded perspective view showing still another golf club head embodying the present invention, in a third embodiment of the invention.

Referring to FIG. 9, there is shown a club head C (namely, what is called a "metal head"), to which the present invention is applied. The club head C consists of a face member 41 and a hollow member 42.

The differences between the third embodiment and the second embodiment of the present invention reside in that the raised portion 31*a* of the second embodiment (namely, the club head B) is formed in such a manner as to have a width which gradually decreases in a direction from the neck part 31*b* to the toe, whereas a front-end peripheral edge part 42*a* of the hollow member 42, FIG. 9, is formed correspondingly to a rear-end peripheral edge part 41*c* of a raised portion 41*a* of the third embodiment (namely, the club head C).

The third embodiment has an advantage in that when the face portion 41 and the hollow member 42 are butt-joined, the positioning thereof is facilitated by the V-shaped rear-end peripheral edge part 41*c* and the V-shaped front-end peripheral edge part 42*a*.

Further, as a result of shaping the rear-end peripheral edge part 41*c* like a letter V, the welding portion is set apart from the neck part 41*b*. Thereby, the stiffness of the neck part 41*b*, on which large stress is imposed at the time of impact, and vicinity can be maintained.

Figure 11:
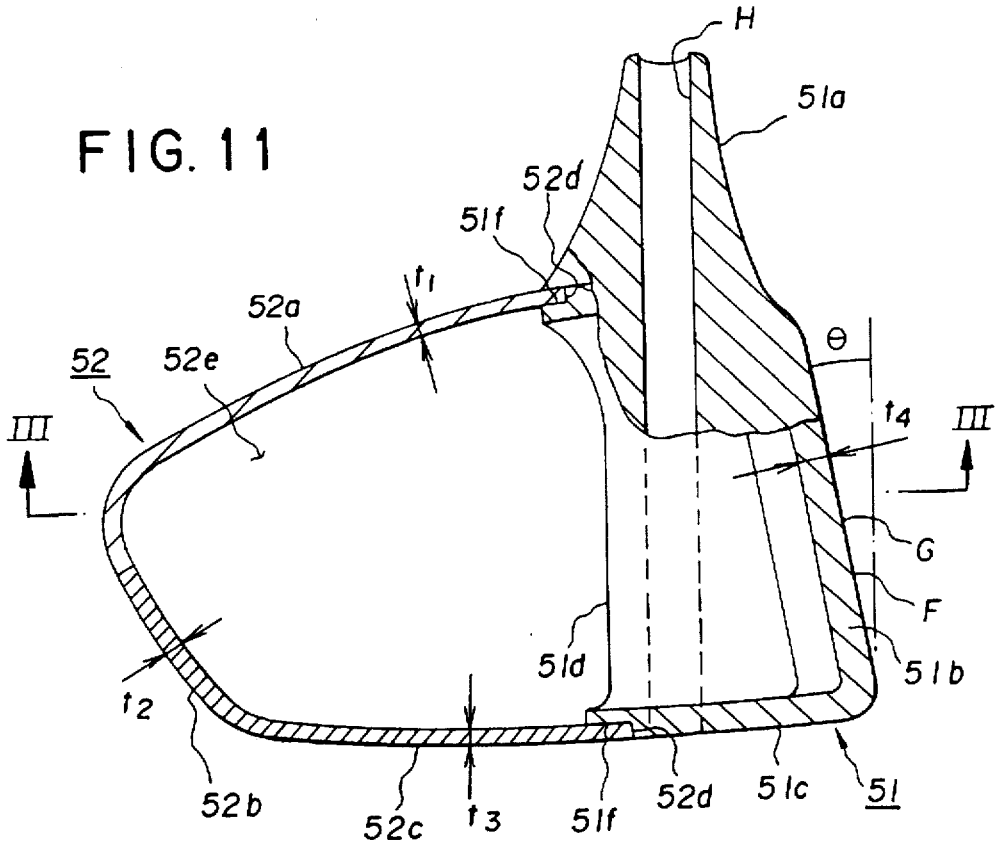
FIG. 11 is a longitudinal sectional view showing the golf club head of a fourth embodiment of the present invention.
Figure 12:
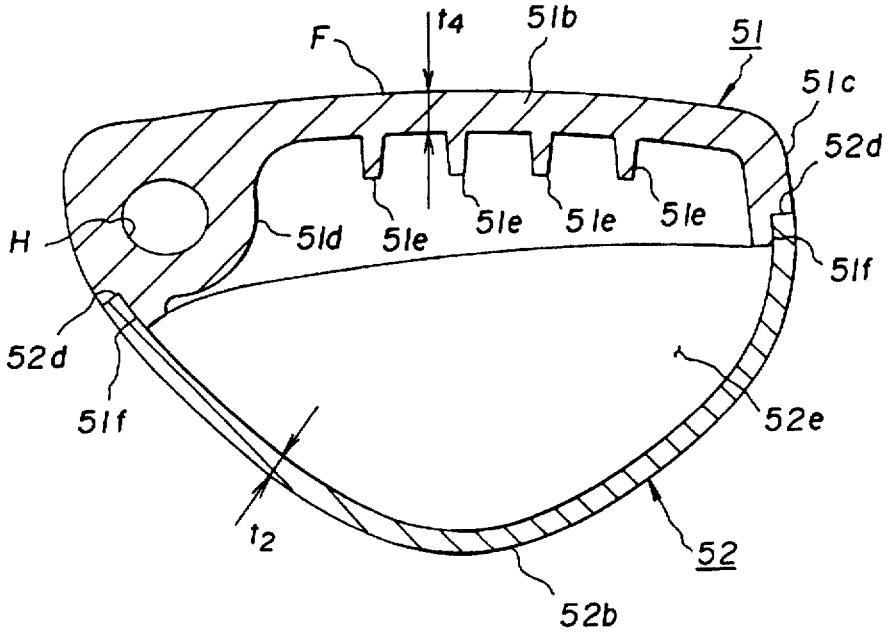
FIG. 12 is a transverse sectional view showing the golf club head of the fourth embodiment of the present invention.
Figure 13:
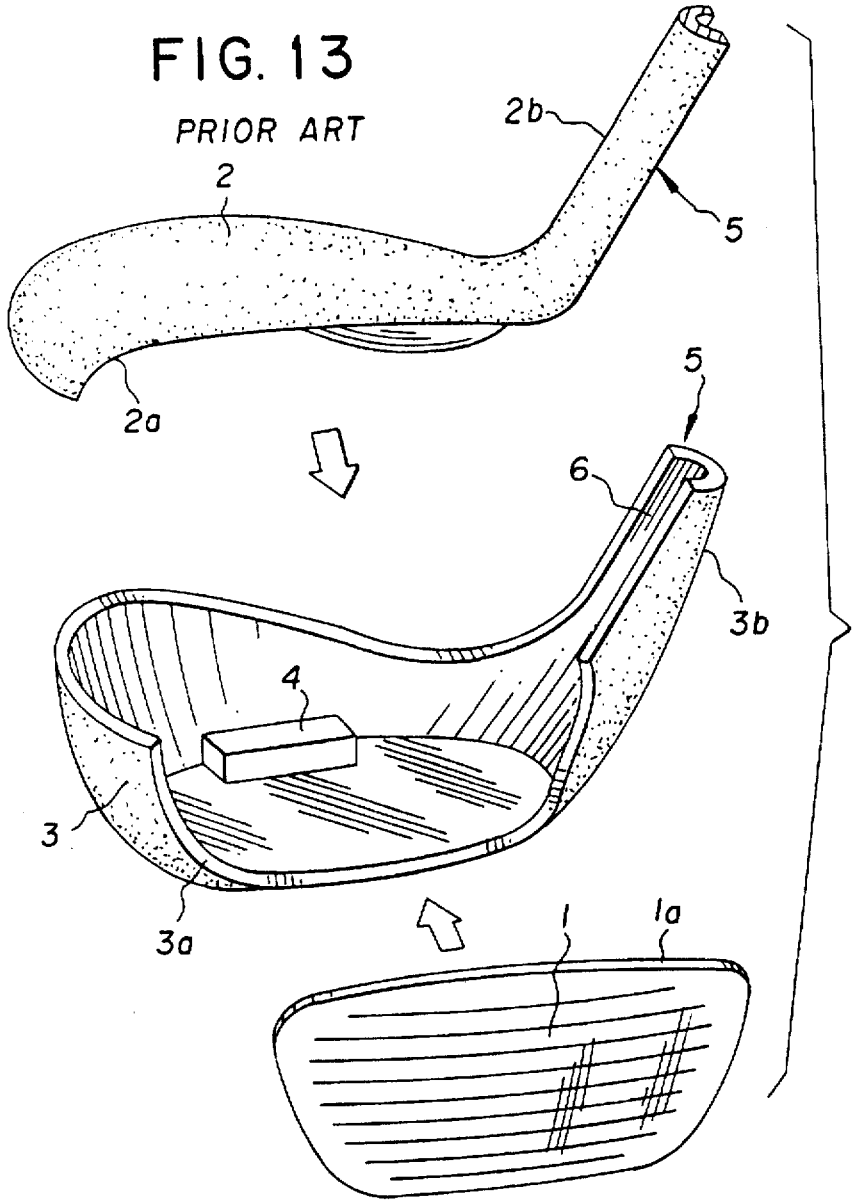
FIG. 13 PRIOR ART
FIG. 13 is an exploded perspective diagram showing a conventional golf club head.
Figure 14:
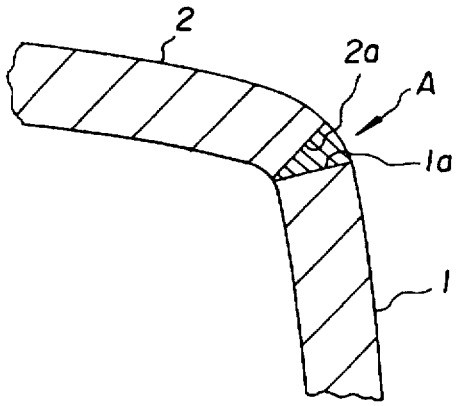
FIG. 14 PRIOR ART
FIG. 14 is a sectional view showing a primary part of the welding portion of the conventional golf club head of FIG. 13.

Next, the fourth embodiment of the present invention will be described hereinbelow by referring to FIGS. 10 to 12.

Figure 10:
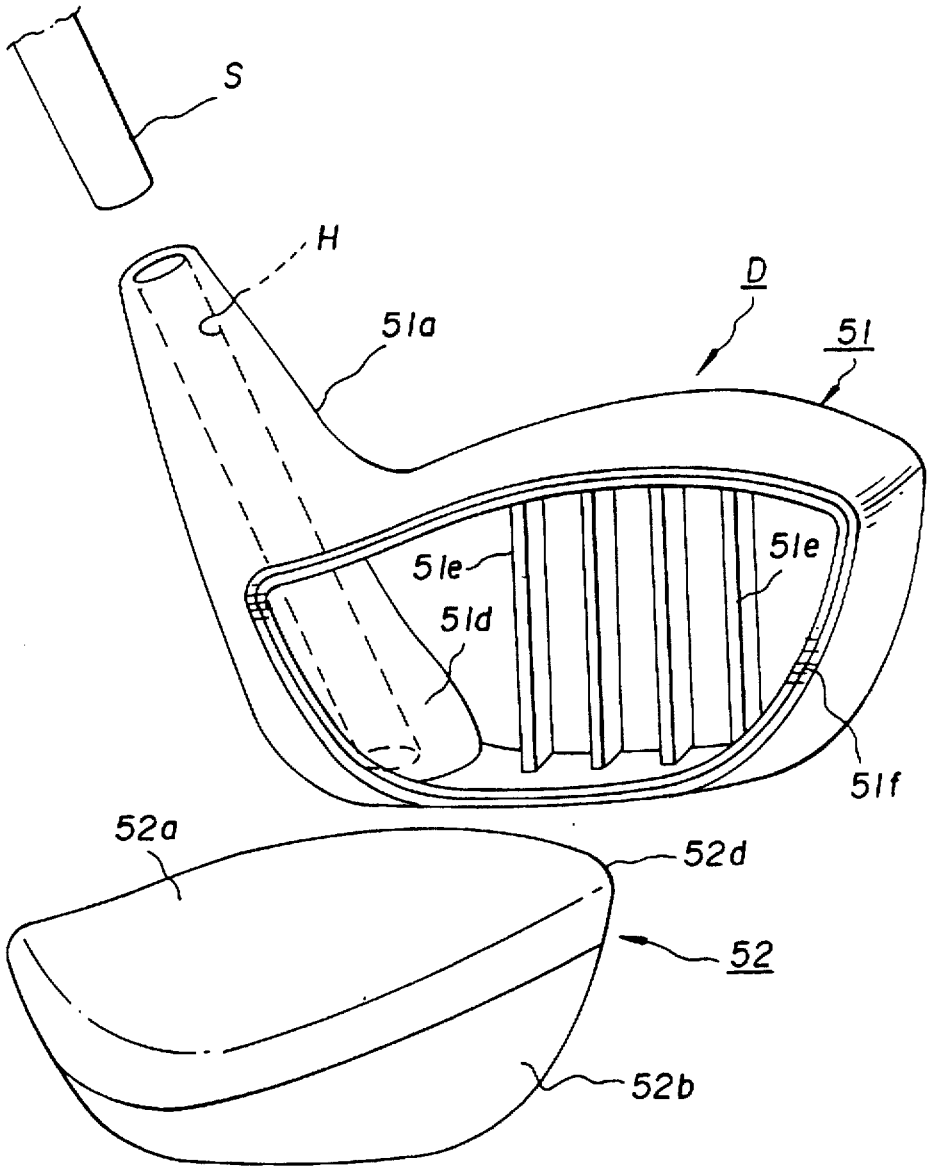
FIG. 10 is an exploded perspective view showing yet another golf club head embodying the present invention, in a fourth embodiment of the present invention.

Referring to FIG. 10, there is shown a club head D (namely, what is called a "metal head"), to which the present invention is applied. The club head D consists of a face member 51 and a hollow member 52.

The face member 51 is formed by forging a near-β titanium alloy (for example, Ti-10V-2Fe-3Al, Ti-9V-2Mo-2Al or the like) and is molded integrally with a neck part 51*a* to which the shaft S is attached. As illustrated in FIGS. 11 and 12, the face member 51 consists of: a face portion 51 whose front surface is a face surface F; a raised portion 51*c* which is formed like a ring and is raised in such a manner as to project from the peripheral edge part of the face portion 11*b* in a direction opposite to a direction to which the face surface F faces; and a protruding portion 51*d* which extends in a direction of the prolonged line of the neck part 51*a* to the bottom end of the face member 51 and protrudes inwardly from the face portion 51*b*.

A shaft insertion hole H is bored in the neck part 51*a* by machining. The shaft insertion hole H is formed in such a way as to penetrate through the protruding portion 51*d* from the top end of the neck part 51*a* to the bottom end of the face member 51. The shaft S is inserted by an appropriate means thereinto and is fixed thereto.

In the raised portion 51*c*, a rear-end peripheral edge part 51*f*, which is shaped like a step so as to be welded to the hollow member 52, is formed.

A plurality of ribs 51*e* (namely, ridge portions) linearly extending in the longitudinal direction thereof are formed on the back surface of the face portion 51*b*.

The hollow member 52 is obtained by welding a crown part 52*a* and a sole part 52*c*, which are formed by performing a precision casting process, together in such a way as to be integral with each other. Further, a hollow portion 52*e* is formed by butt-welding a peripheral edge part of the face member 51, namely, a rear-end peripheral edge part 51*f* of the raised portion 51*c* to a front-end peripheral edge part 52*d* of the hollow member 52.

The thickness of the hollow member, namely, each of the thicknesses t1, t2 and t3, respectively, corresponding to the crown part 52*a*, the side part 52*b* and the sole part 52*c* thereof is set at a value which is within a range of (⅓) of the thickness t4 of the face portion 51*b* to (½) thereof.

Because the protruding portion 51*d* is formed in such a manner as to extend in the direction of the prolonged line of the neck part 51*a* in the face portion 51, the stiffness of the neck part 51*a* and vicinity is increased. Further, the integration of the neck part 51*a* with the shaft S is securely achieved. Thus, a load imposed on the face portion 51*b* at the moment of impact with a golf ball can be securely transferred to the shaft S.

In this case, the protruding portion 51*d* is formed in such a way as to extend to the bottom end of the face member 51, so that the stiffness of the face member 51 is further increased. The bottom position of the protruding portion becomes lower than the center G of figure in the sweet area of the face surface F, so that the center of gravity of the entire golf club head D is lowered.

The face portion is molded of a near-B titanium alloy. Moreover, such an alloy can be forged at a relatively low temperature (750° C.). Thus, the cost for manufacturing facilities is low. Consequently, the manufacturing cost is reduced. Furthermore, because of the fine structure of the alloy, the club head of this embodiment can obtain high strength similarly as in the case of employing a β titanium alloy.

In the case of this embodiment, the capacity of the club head D can be increased to a large value by setting the thickness t4 of the face portion 51*b*, on which a load is directly imposed at the time of impact, at a large value and by further setting each of the thickness t1 of the crown part 52*a* and the thickness t3 of the sole part 52*c* at a small value. Consequently, a large sweet area can be obtained.

In accordance with the present invention, the following advantages can be obtained:

(1) In the above embodiments of the present invention, stress concentration on the welding portion at the time of impact is reduced and the durability of a club head can be improved by butt-welding the rear-end peripheral edge part of the raised portion to the front-end peripheral edge part of the hollow member.

Moreover, the stiffness of the face portion is increased, and the thickness and weight of the club head can be reduced.

Furthermore, as a result of the reduction in weight, a golf club head of large capacity can be obtained. Additionally, a large sweet area can be ensured.

Besides, the face member is molded integrally with the neck part, so that the variation in loft angle among produced golf club heads can be reduced and a tough metallographic structure having continuous grain flow from the face member to the neck part can be obtained. In addition, a loft angle can be easily obtained as preliminarily set.

Owing to the mutually potentiating effects of the aforementioned advantages, the stiffness of the entire golf club head is increased and the directional accuracy of a hit ball, namely, the accuracy of a direction, in which a hit ball flies, can be improved. Thereby, the probability of an occurrence of a vibration of the club head (namely, by missing the sweet area) at the moment of impact is reduced. Thus, a ball can be hit stably in an accurate direction.

(2) In the golf club of the present invention, the stiffness of the neck part and vicinity is increased, and further the neck part is securely integrated with the shaft by forming the protruding portion on the inner side of the face portion. Thus, the pleasant feeling afforded by hitting a ball can be enhanced.

(3) In the golf club head of the present invention, the face member is formed by forging, so that the stiffness thereof can be increased and the thickness and weight thereof can be reduced. Moreover, the hollow member is formed by the precision casting. Thus, the degree of freedom of choice of a shape thereof when produced is high. Furthermore, the thickness of each part thereof is freely set.

Consequently, the arbitrary setting of the position and size of the sweet area in the golf club head can be facilitated and the number of components and that of steps of a fabrication process can be reduced by setting the thickness of each component of the golf club head correspondingly to each kind (or model) of the golf club head to thereby regulate the weight balance of the hollow member and the golf club head, even if a balance weight is not provided therein separately from the hollow member.

(4) In the golf club head of the present invention, the face member is molded of a titanium alloy, so that high stiffness thereof is obtained. Furthermore, the strength thereof can be increased to a high level by a thermo-mechanical treatment. Consequently, the thickness of the face portion can be reduced to a small value. Moreover, the weight thereof can be decreased.

(5) In the golf club head of the present invention, at least the face portion is molded of a β titanium alloy or a near-β titanium alloy, so that the cost of manufacturing is low. Thus, the golf club heads, having high-strength face portions, can be produced at low cost.

(6) In the golf club head of the present invention, the hollow member is such that the thickness thereof becomes gradually larger toward the sole part. Thus, the center of gravity of the golf club head is lowered. Further, a ball can be easily hit by the golf club head so that the hit ball follow high trajectories. Moreover, the golf club head is adapted so that the sole part, which frequently comes into contact with the ground, has the highest stiffness.

(7) In the golf club head of the present invention, as a result of setting the thickness of the hollow member at a value which is within a range of (⅓) of the thickness of the face portion to (½) thereof, a golf club head of large capacity can be obtained by maintaining the stiffness and the weight of the entire golf club head. Consequently, a large sweet area can be ensured.

What is claimed is:

1. A metallic golf club head having an end portion, on which a neck part is formed, and a hollow portion therein, said golf club head further comprising:

a face member molded integrally with the neck part; and a hollow member that is welded to peripheral edge portion of the face member to provide the hollow portion, wherein the face member has a face portion, whose front surface is a face surface of the club, and a raised portion formed like a ring around the face surface in such a way as to project from a peripheral edge part of the face portion in a direction opposite to a direction to which the face surface is faced, wherein a rear-end peripheral edge part of the raised portion is butt welded to a front-end peripheral edge part of the hollow member and wherein a width of the raised portion gradually narrows from the neck part to a toe portion of the face member.

2. A golf club head having an end portion, on which a neck part is formed, and a hollow portion therein, said golf club head further comprising:

a face member molded integrally with the neck part;

a hollow member that is welded to peripheral edge portion of the face member to provide the hollow portion; and a protruding portion which extends in a direction of a prolonged line of the neck part and protrudes inwardly from the face portion, wherein the face member has a face portion, whose front surface is a face surface of the club, and a raised portion formed like a ring around the face surface in such a way as to project from a peripheral edge part of the face portion in a direction opposite to a direction to which the face surface is faced, and wherein a rear-end peripheral edge part of the raised portion is butt welded to a front-end peripheral edge part of the hollow member.

3. The golf club head according to claim 1 or 2, wherein the face member is formed by forging, wherein the hollow member is formed in one piece by precision-casting.

4. The golf club head according to claim 1 or 2 wherein the face member and/or the hollow member are molded of a titanium alloy.

5. The golf club head according to claim 1 or 2 wherein at least the face portion is molded of a β titanium alloy or a near-β titanium alloy.

6. The golf club head according to claim 1 or 2 wherein the hollow member includes:

a crown part which composes an upper division thereof;

a side part which composes a side division thereof; and a sole part which composes a bottom division thereof, wherein a thickness (t1) of the crown part, a thickness (t2) of the side part and a thickness (t3) of the sole part meet the following relations: $t1 \leqq t2 \leqq t3$; and $t1 < t3$.

7. The golf club head according to claim 1 or 2 wherein a thickness of the hollow member is set at a value which is within a range of (⅓) of a thickness of the face portion to (½) thereof.

8. The golf club head according to claim 3 wherein the face member and/or the hollow member are molded of a titanium alloy.

9. The golf club head according to claim 3 wherein at least the face portion is molded of a β titanium alloy or a near-β titanium alloy.

10. The golf club head according to claim 3 wherein the hollow member includes:

a crown part which composes an upper division thereof;

a side part which composes a side division thereof; and a sole part which composes a bottom division thereof, wherein a thickness (t1) of the crown part, a thickness (t2) of the side part and a thickness (t3) of the sole part meet the following relations: $t1 \leqq t2 \leqq t3$; and $t1 < t3$.

11. The golf club head according to claim 3 wherein a thickness of the hollow member is set at a value which is within a range of (⅓) of a thickness of the face portion to (½) thereof.

12. The golf club head according to claim 4 wherein at least the face portion is molded of a β titanium alloy or a near-β titanium alloy.

13. The golf club head according to claim 4 wherein the hollow member includes:

a crown part which composes an upper division thereof;

a side part which composes a side division thereof; and a sole part which composes a bottom division thereof, wherein a thickness (t1) of the crown part, a thickness (t2) of the side part and a thickness (t3) of the sole part meet the following relations: $t1 \leqq t2 \leqq t3$; and $t1 < t3$.

14. The golf club head according to claim 4 wherein a thickness of the hollow member is set at a value which is within a range of (⅓) of a thickness of the face portion to (½) thereof.

15. The golf club head according to claim 5 wherein the hollow member includes:

a crown part which composes an upper division thereof;

a side part which composes a side division thereof; and a sole part which composes a bottom division thereof, wherein a thickness (t1) of the crown part, a thickness (t2) of the side part and a thickness (t3) of the sole part meet the following relations: $t1 \leqq t2 \leqq t3$; and $t1 < t3$.

16. The golf club head according to claim 5 wherein a thickness of the hollow member is set at a value which is within a range of (⅓) of a thickness of the face portion to (½) thereof.

17. The golf club head according to claim 6 wherein a thickness of the hollow member is set at a value which is within a range of (⅓) of a thickness of the face portion to (½) thereof.

* * * * *